US005199414A

United States Patent [19]

McMillon

[11] Patent Number: 5,199,414

[45] Date of Patent: Apr. 6, 1993

[54] HAMMOCK FILTER FOR AIR CONDITIONER

[76] Inventor: Donald C. McMillon, P.O. Box 187, Snyder, Tex. 79549

[21] Appl. No.: 960,780

[22] Filed: Oct. 14, 1992

[51] Int. Cl.[5] ..... F24H 3/02; B01D 46/10

[52] U.S. Cl. ..... 126/99 R; 126/110 R; 55/484; 55/493; 55/496

[58] Field of Search ..... 165/119; 55/484, 493, 55/496, 508, 509; 126/99 R, 110 R

[56] References Cited

U.S. PATENT DOCUMENTS

| | | | |
|---|---|---|---|
| 1,887,737 | 11/1932 | Shurtleff | 55/493 |
| 2,175,903 | 10/1939 | Lichtman | 55/496 |
| 2,624,405 | 1/1953 | Lynch | 55/496 |
| 2,685,345 | 8/1954 | Lindner | 55/509 |
| 3,218,784 | 11/1965 | Greiner | 55/493 |
| 3,294,082 | 12/1966 | Norris | 126/110 R |
| 3,755,995 | 9/1973 | Stickel | 55/509 |
| 3,778,985 | 12/1973 | Daigle et al. | 55/493 |
| 3,810,350 | 5/1974 | Scholl | 55/493 |
| 4,827,901 | 5/1989 | Jackson et al. | 126/99 R |
| 5,056,500 | 10/1991 | Evens | 126/110 R |

*Primary Examiner*—John Rivell
*Assistant Examiner*—L. R. Leo
*Attorney, Agent, or Firm*—Wendell Coffee

[57] ABSTRACT

A heating and air conditioning unit has a fan compartment containing a hammock-type filter. The hammock-type filter rests upon feet elevated above the bottom of the fan compartment so that air may flow into the fan through either the bottom panel of the hammock filter or either of the side panels. The front and back of channels of the bottom pannel are telescoped so that they can be expanded and always be longer than the width of the fan. Sponge rubber is provided at the front and back so that if a larger compartment is used that air leakage at the front and back is prevented by the sponge or foam rubber. The top edges of the side panels rest against the sides of the fan compartment. Foam rubber along these edges prevents noise caused by vibration as well as preventing air leakage. The hammock filter is readily removed from the fan compartment and the filter unit is inserted by either tucking the filter into the channel, if it is flexible or sliding it in through one end, having removed an end channel to provide an opening therefore. If a flexible filter is used a stiff mesh is placed upon the fan side of the filter to prevent the flow of air from ballooning the filter out of the channels. Also, rubber bands are extended diagonally across any panel if the stiff mesh is not sufficient to prevent the ballooning.

19 Claims, 2 Drawing Sheets

HAMMOCK FILTER FOR AIR CONDITIONER

CROSS REFERENCE TO RELATED APPLICATION:

None, however, Applicant filed Disclosure Document Number 311,973 on Jun. 30, 1992 which document concerns this application; therefore, by separate paper it is respectfully requested that the document be retained and acknowledgment thereof made by the Examiner. (MoPEP 1706)

BACKGROUND OF THE INVENTION (1) Field of the Invention

This invention relates to residential-type air conditioners and more particularly to replaceable filters therefore. An ordinary householder is one having ordinary skill in this art.

(2) Description of the Related Art

FIG. 1 shows a conventional air conditioning unit having heat transfer unit 10 and fan compartment 12. The fan compartment will have fan 14 projecting from the top structure of the fan compartment into the fan compartment. The conventional units on the market today have a flat filter over and covering lower inlet opening 16 in the bottom of the fan compartment 12.

For a short period of time, LENNOX, a manufacturer of furnaces and air conditioners marketed a hammock-type filter built substantially as shown in the GREINER Patent 3,218,784. This filter was supported from the sides of the fan compartment by clips or hangars on each side of the side fan compartment. The GREINER Patent, as understood, had a "renewable filter pad".

Later, an embodiment Patent 3,810,350 by SCHOLL was believed to have been marketed by American Air Filter Company, Inc.

In early 1992, hammock-type air conditioner filters were not commercially on the market.

LICHTMAN, 2,175,903, discloses an air conditioner filter having a telescoping adjustable frame to fit different sizes of openings.

SUMMARY OF THE INVENTION (1) Progressive Contribution to the Art

I have invented a filter unit which is readily adaptable to fit different sizes of fan compartments and which is supported by the bottom structure of the fan compartment. This design is easier for the householder to remove the filter frame, remove the old filter from the frame, replace the filter, and replace the renewed filter unit within the fan compartment.

The filter is comprised of three panels, a bottom panel which is supported by feet above the bottom structure of the fan compartment, and two additional panels which are hinged to the bottom panel The two additional panels rest against the sides of the fan compartment. Foam rubber at the front and back is provided in the event that the measurement from the front to back of the compartment is larger than the measurement of the front to back of the filter panels.

(2) Objects of this Invention

An object of this invention is to provide additional filter area for household type air-conditioner units which is easy to remove and install new filters Another object of this invention is to provide a framework for accomplishing the above, said frame being constructed to use different types of filter elements or media.

Another object of this invention is to provide such a frame as described above which can be adjusted to fit different size fan compartments.

Further objects are to achieve the above with devices that are sturdy, compact, durable, lightweight, simple, safe, efficient, versatile, ecologically compatible, energy conserving, and reliable, yet inexpensive and easy to manufacture, install, operate, and maintain.

The specific nature of the invention, as well as other objects, uses, and advantages thereof, will clearly appear from the following description and from the accompanying drawings, the different views of which are not necessarily scale drawings.

Figure 2:
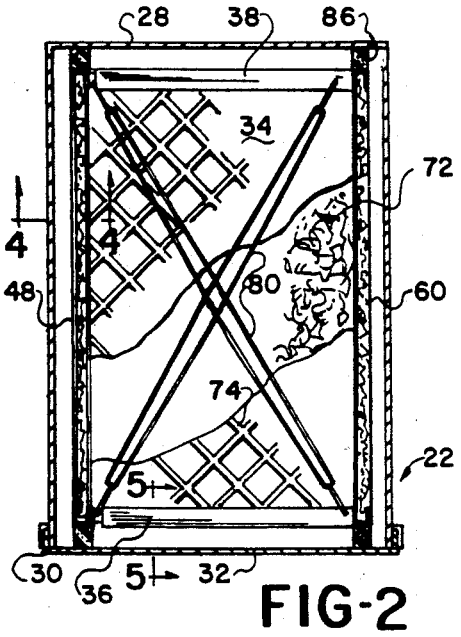
FIG. 2 is a plan sectional view taken substantially on line 2—2 of FIG. 1.

As an aid to correlating the terms of the claims to the exemplary drawings, the following catalog of elements and steps is provided:

10 heat transfer compartment
12 fan compartment
14 fan
16 air inlet opening
18 top structure
20 bottom structure
22 hammock filter
24 closed side structure
26 open side structure
28 back structure
30 front structure
32 closure
34 rectangular bottom panel
36 front bottom channel
38 back bottom channel
40 closed side strap
42 entry side strap
44 nuts
46 bolts, feet
48 closed panel
50 front closed channel
52 hinge
54 back closed channel
56 hinge
58 closed end channel
60 entry panel
62 front entry channel
64 hinge
66 back entry channel
68 hinge 70 entry end channel
72 filter
74 mesh
76 fan side or face
78 inlet side or face
80 resilient retainer units
82 spring flange
84 spot weld
86 sponge rubber
88 sponge rubber strip
90 male channel
92 female channel
94 close brace
96 entry brace

DESCRIPTION OF THE PREFERRED EMBODIMENTS

Figure 1:
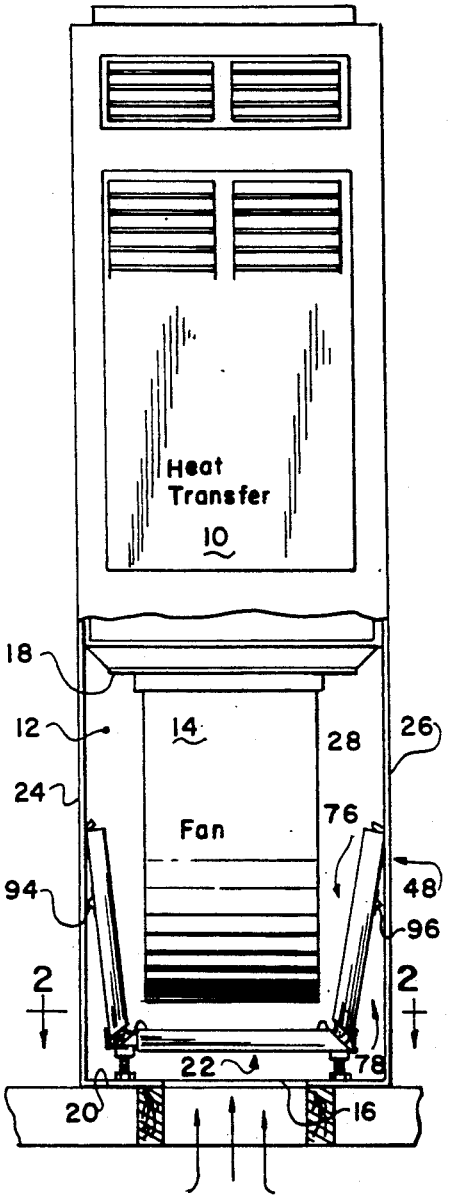
FIG. 1 is a front elevational view with the fan compartment cover removed showing an air-conditioner unit with an embodiment of this invention.
Figure 3:
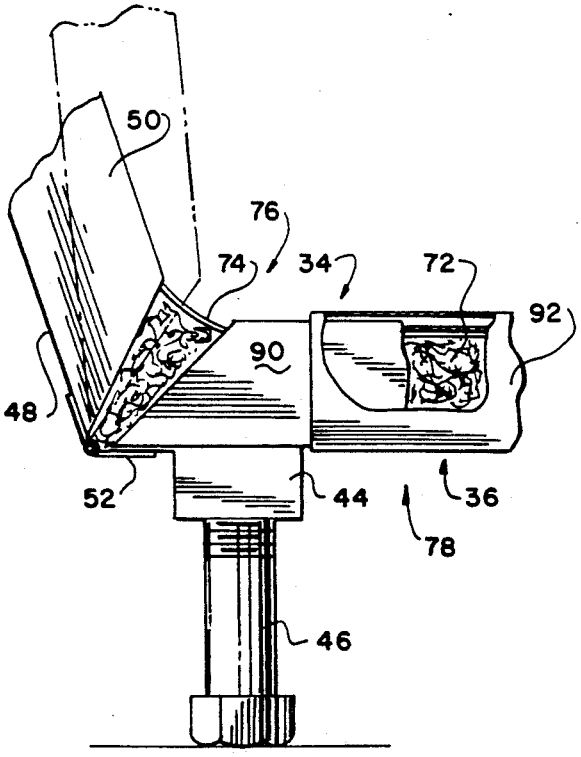
FIG. 3 is a detail of one of the hinge joints and foot screw taken as a front elevational view from the same point of view as FIG. 1.
Figure 4:
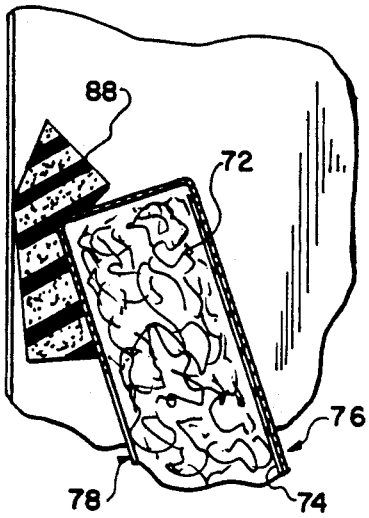
FIG. 4 is a detail of the upper end of one of the hinged panels and its contact with the side wall.

Referring to FIG. 1 there may be seen a front elevational view of an air-conditioner unit according to this invention. The air-conditioning unit has heat transfer compartment 10 above fan compartment 12. The fan compartment has fan 14 attached to top structure 18. Bottom structure 20 of the fan compartment 12 has air inlet opening 16 therein. With the fan in operation, the air is drawn in through the air inlet opening 16 through hammock filter 22 and into the fan. The fan blows the filtered air through an opening (not shown) in the top structure 18.

The fan compartment 12 also has closed side structure 24 and open side structure 26.

Although the air intake has been described as being in the bottom structure 20, it will be understood by those skilled in the art, that the air intake 16 could be from either of the side structures, as for example shown in GREINER U.S. Pat. No. 3,218,784.

The compartment also has back structure 28 and front structure 30. The front structure opens for servicing the fan and filter but closure 32 is over the opening in the front structure 30.

The hammock filter unit 22 includes rectangular bottom panel 34. The rectangular bottom panel includes front bottom channel 36 which forms the front of the bottom rectangle. Back bottom channel 38 forms the back of the bottom rectangle.

Figure 7:
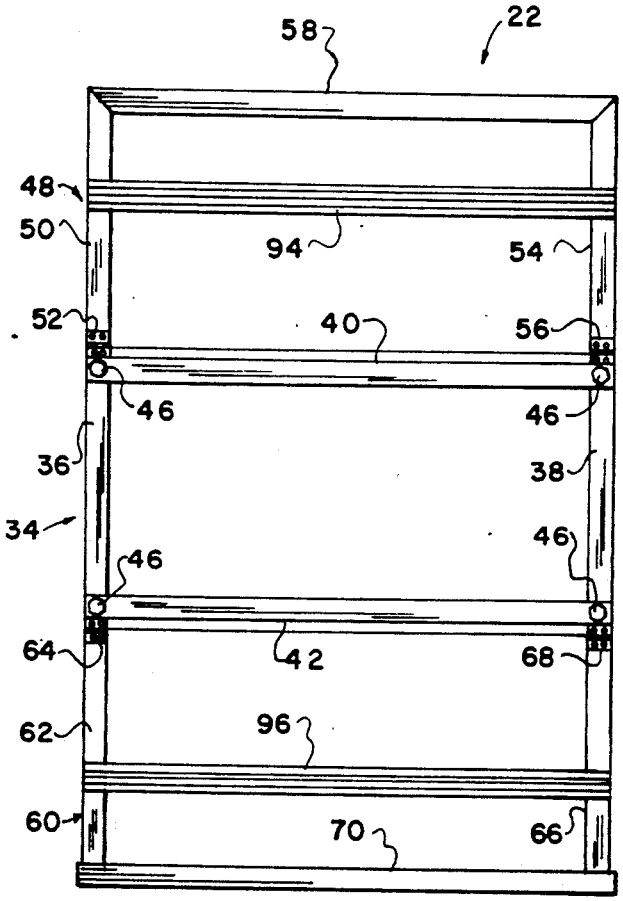
FIG. 7 is a bottom plan view of the frame of the filter in the expanded or unfolded position.

Referring to FIG. 7 closed side strap 40 forms a closed side of the bottom rectangle and entry side strap 42 forms the entry side of the bottom rectangle. The strap 40 attaches at one end to the front channel 36 and at the other end to the back channel 38. Likewise strap 42 will be attached at one end to the front channel 36 and at the other end to the back channel 38. Each of the straps 40 and 42 are attached to one of the channels 36 and 38 at each corner of the rectangle as seen in FIG. 7. Although the structures identified as 40 and 42 are described as straps, I prefer that they be in the form of small channels for rigidity of the bottom rectangle, however the channel structure of the straps 40 and 42 are for structural purposes only and not for the purposes of inserting a filter therein as are the channels 36 and 38.

At each corner of the rectangle of the bottom panel 34, nut 44 is placed within the channels forming the straps 40 and 42 and secured in place as by spot welding. Feet in the form of bolts 46 are threaded into the nuts to support the bottom panel 34 above the bottom structure 20 so there is a free flow of air around the bottom of the hammock 22 as discussed later. Since the bolts 46 form adjustable feet it is preferred they be made of nylon, inasmuch as normally a nylon bolt into a steel nut can be hand turned to adjust the height of the foot formed by the bolt, but once adjusted will normally not vibrate to a different position in use.

Rectangular closed panel 48 has front closed channel 50 forming the front side of the rectangle. One end of front closed channel 50 is hinged by hinge 52 to a corner of the bottom panel 34. Specifically, one side of the hinge 52 is attached to the front closed corner of closed side strap 40. The closed side strap 40 also forms one side of the rectangle which defines the closed panel 48. Back closed channel 54 is hinged by hinge 56 to the back end of closed side strap 40. The back closed channel 54 forms the back side of the rectangle of the closed panel 48. Closed end channel 58 is attached as by welding to the ends of channels 50 and 54. It will form the closed side of the rectangle of closed panel 48.

Entry panel 60 also is rectangular and entry side strap 42 defines one side of the rectangle of the entry panel 60. Front entry channel 62 is hinged by hinge 64 to the front of entry side strap 42.

Back entry channel 66 is hinged by hinge 68 to the back end of entry side strap 42. Back entry channel 66 forms the back side of the entry panel 60. Entry end channel 70 forms the entry side of the entry panel 60. It is removably attached to the front and back channels 62 and 66. Therefore when the end channel 70 is removed the channels 60 and 62 are opened for entry of filter 72 therein. For this reason the panel 60 is called the entry panel because the filter may be entered at this end and the panel 48 is called the closed panel since this panel is closed and a filter cannot be entered by sliding into this panel.

All of the channels 36, 38, 50, 54, 58, 62, 66, and 70 are opened to the inside of the rectangles. Therefore the filter 72 may be slid into the channels This is important in the event that a rather rigid filter element 72 is used. In some cases the householder may elect to use a rather flexible filter element such as matted fibers or the like. In such an instance matted fibers or other flexible material may be inserted into the channels without the removal of the entry end channel 70. However, if more rigid type filters such as a pleated filter as shown in DAIGLE et al, U.S. Pat. No. 3,778,985 is used, it would be necessary or desirable to slide the filter from the entry side of the entry panel.

If a flexible filter element is used it is desired that stiff mesh 74 be inserted on a fan side 76 of the filter. It will be understood that the filter unit 22 will have a fan face or side 76 facing the fan 14 and inlet side 78 opposite the fan side or face. I have found that plastic mesh having approximately 3/" diamonds as used by construction workers to place around open manholes is a suitable material for the mesh 76. Although this material is somewhat stiff it may also be inserted over a flexible material without the removal of the entry end channel 70.

Also, it will be evident that the filter element 72 will be rectangular. The filter element will have a depth equal to the length of the straps 40 and 42. The rectangular filter element 72 will have a length equal to the length of the front closed channel 50, the front bottom channel 36, and the front open channel 60.

As described the mesh 74 will have a certain amount of flexibility. It has been found, that with the entry air entering immediately below the bottom panel 34 the filter 72 in the bottom panel is sometimes ballooned or carried up by the flow of air. This problem is readily solved by having two thin resilient retainer elements 80 diagonally attached across the rectangular bottom panel 34 on the fan face 76. If the air intake were in the open side structure 26 as seen in FIG. 1, it would be desirable to have flexible retainer units 80 extending diagonally across the entry panel 60. Rubber bands having wire hooks on each end have been found suitable for use as thin resilient retainer elements They are readily attached by small holes drilled through the channels of the corners of the panel to which they are to be affixed.

Figure 6:
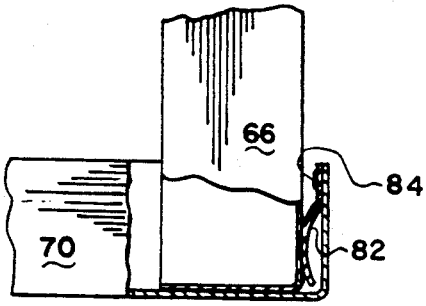
FIG. 6 is a detail of the construction of one of the corners of a removable side for inserting a filter into the frame.

Entry end channel 70 telescopes over the ends of the front and back entry channels 62 and 66. A spring flange 82 is attached near each end of the channel 70 to hold the end channel 70 securely in place once attached. The flanges 82 are attached to the closed by spot welding 84 as seen in FIG. 6.

In many instances the front and back channels 36 and 38 as well as the front and back channels 50, 54, 62, and 66, will fit snugly against the back structure 28 and the closure 32 over the front structure 30. However, some fan compartments 12 are made deeper, i.e., the distance from the back structure 28 to the front structure 30 is greater than in other chambers. In deeper chambers, sponge rubber 86 is inserted or lightly adhered to the front and back channels to close off any air passages therein. Likewise, in many instances the end channels 58 and 70 will rest against the side structures 24 and 26. However, should vibration cause any noise at this point, it can be readily silenced by placing sponge rubber strip 88 along the length of the end channels 58 and 70.

Figure 5:
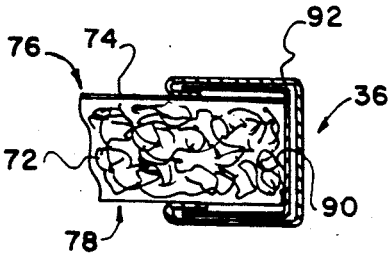
FIG. 5 is a sectional detail view taken on line 5—5 of FIG. 2 of the telescoping front portion of the front of the bottom panel with a filter inserted therein.

It may readily be seen that if the distance between the fan compartment sides 24 and 26 is larger than that proportionately shown in FIG. 1, that the hinges 52, 56, 64, and 68, will permit the panels 48 and 60 to fold out to close the air flow. However, if the fan unit 14 is wider than the distance from strap 40 to 42 it would be necessary to expand the distance between the straps 40 and 42. This is accomplished by making the front and back channels 36 and 38 a composite channel so that they can be expanded For simplicity and conciseness only the front composite channel 36 is shown in FIG. 5. The composite channel 36 includes male channel 90 which is attached to strap 40. Female channel 92 of composite channel 36 is attached to the strap 42. Therefore these two channels 90 and 92 telescope one over the other so that the length of the composite channel 36 and 38 may be adjusted so that the bottom panel is wider than the fan 14.

Close brace 94 is attached as by spot welding between the front and back closed channels 48 and 54 on the inlet face side 78.

Entry brace 96 is attached as by spot welding between the front and back entry channels 62 and 66 on the inlet side or face 78. These braces 94 and 96 aid in maintaining the filter media 72 within the frame channels. Also, the brace 96 holds the channels 62 and 66 in position when the entry end channel 70 is removed.

The embodiment shown and described above is only exemplary. I do not claim to have invented all the parts, elements or steps described. Various modifications can be made in the construction, material, arrangement, and operation, and still be within the scope of my invention.

The restrictive description and drawings of the specific examples above do not point out what an infringement of this patent would be, but are to enable one skilled in the art to make and use the invention. The limits of the invention and the bounds of the patent protection are measured by and defined in the following claims.

I claim as my invention:

1. In a space heating and air-conditioning unit having a. a heat transfer compartment above b. a fan compartment, having i. a top structure, ii. a bottom structure, iii. two side structures, iv. a back structure, and v. a front structure, c. a fan attached to the top structure, d. a removable closure over an opening in the front structure, and e. an air inlet in at least one of the bottom and side structures;

f. an improved filter structure comprising in combination with the above:

g. a rectangular bottom filter panel extending from the back structure to the closure over the front structure, h. feet extending between the bottom filter panel and the bottom structure thus supporting the bottom filter panel above the bottom structure, j. a rectangular closed filter panel extending from the back structure to the closure over the front structure, k. the closed filter panel having a hinge side attached to a closed hinge side of the bottom panel, l. the closed filter panel having a closed side contacting one of the side structures above said hinge side, and m. a rectangular entry filter panel extending from the back structure to the closure over the front structure, n. the entry filter panel having a hinge side attached to an entry hinge side of the bottom panel, and o. the entry filter panel having an entry side contacting another of the side structure above said hinge side.

2. A filter holder adapted to be used in a space heating and air-conditioning unit having a. a heat transfer compartment above b. a fan compartment, having i. a top structure, ii. a bottom structure, iii. two side structures, iv. a back structure, and v. a front structure, c. a fan attached to the top structure, d. a removable closure over an opening in the front structure, and e. an air inlet in at least one of the bottom and side structures;

f. said filter holder comprising:

g. a rectangular bottom panel frame having i. a front bottom channel forming the front of the rectangle, ii. a back bottom channel forming the back of the rectangle, iii. a closed side strap forming a closed side of the rectangle, and iv. an entry side strap forming an entry side of the rectangle, v. each strap attached to one of the channels at each corner of the rectangle, h. the bottom panel frame adapted to be supported by said bottom structure, j. a rectangular closed panel frame having i. said closed side strap forming a hinge side of the closed panel, ii. a front closed channel forming a front side of the closed panel hinged to the front bottom channel at the hinge side thereof, iii. a back closed channel forming a back side of the closed panel hinged to the back bottom channel at the hinge side thereof, and iv. a closed end channel forming a closed side of the closed panel attached at each end to one of the front and back closed channels, k. a rectangular entry panel frame having i. said entry side strap forming a hinge side of the entry panel, ii. a front entry channel forming the front side of the entry panel hinged to the front bottom channel at the entry hinge side thereof, iii. a back entry channel forming a back side of the entry panel hinged to the back bottom channel at the entry hinge side thereof, and iv. an entry end channel forming an entry side of the entry panel connected to one of the front and back entry channels at each end thereof, and l. all said channels opening into the interior of the rectangle of which they form a side.

3. The invention as defined in claim 2 further comprising:

m. a foot at each corner of the rectangular bottom panel adapted to elevate and support said filter above the bottom structure.

4. The invention as defined in claim 3 further comprising:

n. said foot being adjustable.

5. The invention as defined in claim 3 further comprising:

n. said foot being in the form of a threaded bolt threaded into a nut at each corner of said bottom filter. .

6. The invention as defined in claim 2 further comprising:

m. said front and back channels of the bottom panel frame each being a composite channel having a female channel telescoped over a male channel in a sliding configuration so that the width of the rectangular frame may be adjusted by slidingly changing the lengths of the front and back sides.

7. The invention as defined in claim 2 further comprising:

m. said entry end channel being removable and n. having a spring flange on at least one end thereof, o. said entry end channel removably attached to said front and back channels by telescoping said front and back channels into said open channel, p. said spring flange gripping at least one of said front and back entry channels firmly.

8. The invention as defined in claim 7 further comprising:

q. a spring flange at each end of said entry end channel.

9. The invention as defined in claim 2 further comprising:

m. said filter frame having a filter therein.

10. The invention as defined in claim 9 further comprising:

n. said filter having a fan face and an intake face opposite thereto, o. a flexible stiff mesh having the same size as said filter on the fan side of said filter, p. said mesh edges being within all of said channels.

11. The invention as defined in claim 9 further comprising:

n. said filter having a fan face and an intake face opposite thereto, o. two thin resilient retainer elements, p. one each extending along one of the diagonals of said bottom rectangular panel on the fan face thereof.

12. In a space heating and air-conditioning unit having a. a heat transfer compartment above b. a fan compartment, having i. a top structure, ii. a bottom structure, iii. two side structures, iv. a back structure, and v. a front structure, c. a fan attached to the top structure, d. a removable closure over an opening in the front structure, and e. an air inlet in at least one of the bottom and side structures;

f. an improved filter unit comprising in combination with the above:

g. a rectangular bottom panel having i. a front bottom channel forming the front of the rectangle, ii. a back bottom channel forming the back of the rectangle, iii. a closed side strap forming a closed side of the rectangle, and iv. an entry side strap forming an entry side of the rectangle, v. each strap attached to one of the channels at each corner of the rectangle, h. the bottom panel supported by said bottom structure, j. a rectangular closed panel having i. said closed side strap forming a hinge side of the closed panel, ii. a front closed channel forming a front side of the closed panel hinged to the front bottom channel at the hinge side thereof, iii. a back closed channel forming a back side of the closed panel hinged to the back bottom channel at the hinge side thereof, and iv. a closed end channel forming a closed side of the closed panel attached at each end to one of the front and back closed channels, k. a rectangular entry panel having i. said entry side strap forming a hinge side of the entry panel, ii. a front entry channel forming the front side of the entry panel hinged to the front bottom channel at the entry hinge side thereof, iii. a back entry channel forming a back side of the entry panel hinged to the back bottom channel at the entry hinge side thereof, and iv. an entry end channel forming an entry side of the entry panel removably connected to one of the front and back entry channels at each end thereof, l. all said channels opening into the interior of the rectangle of which they form a side, m. a rectangular filter element i. having a depth equal to the length of the straps and a length equal to the combined length of the front closed channel, front bottom channel, and front open channel, and ii. having one of said sides of the filter inserted into all of the channels therein.

13. The invention as defined in claim 12 further comprising:

n. said filter having a fan face open to the fan and an intake face on the opposite side thereof, o. a flexible stiff mesh having the same size as said filter on the fan face of said filter.

14. The invention as defined in claim 12 further comprising:

n. said filter having a fan face thereon open to the fan and an intake face opposite thereto, o. two thin resilient retainer elements, p. one each extending along one of the diagonals of said bottom rectangular panel on the fan face thereof.

15. The invention as defined in claim 12 further comprising:

n. said entry end channel having a spring flange at each end thereof, o. said entry end channel attached to said front and back entry channels by telescoping said front and back channels into said open channel, p. said spring flanges gripping said front and back entry channels firmly.

16. The invention as defined in claim 15 further comprising:

q. a spring flange at each end of said entry end channel, r. said mesh edges being within all of said entry channels.

17. The invention as defined in claim 12 further comprising:

n. said, front and back channels of the bottom panel, each being a composite channel having a female channel telescoped over a male channel in a sliding configuration so that the width of the rectangle may be adjusted by slidingly changing the lengths of the front and back sides.

18. The invention as defined in claim 12 further comprising:

n. sponge rubber between all channels and front, back, and side structure.

19. The invention as defined in claim 12 further comprising:

n. an entry brace attached on the inlet face side to and between the front and back entry side channels, and o. a closed brace attached on the inlet face side to and between the front and back closed channels.

* * * * *